US010145565B2

(12) United States Patent
Gambardella et al.

(10) Patent No.: US 10,145,565 B2
(45) Date of Patent: Dec. 4, 2018

(54) DOOR FOR A DOMESTIC COOKING OVEN

(71) Applicant: Whirlpool EMEA S.p.A., Pero (IT)

(72) Inventors: Fabio Gambardella, Catanzaro Lido (IT); Matteo Scoponi, Civitanova Marche (IT)

(73) Assignee: Whirlpool EMEA S.p.A., Pero (IT)

( * ) Notice: Subject to any disclaimer, the term of this patent is extended or adjusted under 35 U.S.C. 154(b) by 410 days.

(21) Appl. No.: 14/677,354

(22) Filed: Apr. 2, 2015

(65) Prior Publication Data

US 2015/0308695 A1 Oct. 29, 2015

(51) Int. Cl.
*F24C 15/04* (2006.01)
*F24C 15/02* (2006.01)

(52) U.S. Cl.
CPC ..... *F24C 15/023* (2013.01); *F24C 15/045* (2013.01)

(58) Field of Classification Search
CPC ..... F24C 15/023; F24C 15/045; F24C 15/04
USPC ..... 126/197, 200
See application file for complete search history.

(56) References Cited

U.S. PATENT DOCUMENTS

| | | | | |
|---|---|---|---|---|
| 9,004,623 | B2 * | 4/2015 | Koitzsch | F24C 15/045 312/328 |
| 2007/0187387 | A1 * | 8/2007 | Kim | F24C 15/006 219/391 |
| 2007/0251520 | A1 * | 11/2007 | Bang | F24C 15/022 126/200 |
| 2012/0060822 | A1 * | 3/2012 | Eberhard | F24C 15/04 126/198 |

FOREIGN PATENT DOCUMENTS

| | | | | |
|---|---|---|---|---|
| DE | 103 36 138 | B3 | 10/2004 | |
| DE | 20 2005 016504 | U1 | 1/2006 | |
| DE | 202005016504 | U1 * | 1/2006 | F24C 15/024 |
| DE | 102012213126 | A1 * | 1/2014 | F24C 15/02 |
| EP | 1 030 116 | A2 | 8/2000 | |
| EP | 1 640 493 | A2 | 3/2006 | |
| EP | 1640493 | A2 * | 3/2006 | D06F 37/42 |
| EP | 2 075 509 | A1 | 7/2009 | |

(Continued)

OTHER PUBLICATIONS

English Translation of DE 102012213126 A1.*

(Continued)

*Primary Examiner* — Jorge Pereiro
(74) *Attorney, Agent, or Firm* — Cesari and McKenna, LLP

(57) ABSTRACT

The present invention relates to a door (3) of a domestic cooking oven (1), in particular of the pyrolytic type. The door (3) comprises at least a first and a second plate (31, 32) and a first and a second upright beam (8, 9). The first plate (31) defines an outer surface of the door (3) and the two upright beams (8, 9) receiving at least the second plate (32) are fixed internally relative thereto. The door (3) further comprises a first and a second locking element (14, 15) removably engaged to the first and second upright beams (8, 9) and configured to be selectively movable between an operating position, wherein they are engaged to the respective upright beams (8, 9) in such a way as to lock at least the second plate (32) in a mounting position, and at least one unlocked position, wherein they enable the second plate (32) to be extracted from the door (3).

10 Claims, 9 Drawing Sheets

(56) References Cited

FOREIGN PATENT DOCUMENTS

| | | | | |
|---|---|---|---|---|
| EP | 2 386 800 | A1 | 11/2011 | |
| EP | 2400226 | A1 * | 12/2011 | ..... F24C 15/045 |

OTHER PUBLICATIONS

Italian Search Report and Written Opinion dated Feb. 16, 2015 for Italian Patent Application No. MI2014A000292 filed on Apr. 8, 2014 by Indesit Company S.p.A., 9 pages.

* cited by examiner

DOOR FOR A DOMESTIC COOKING OVEN

CROSS REFERENCE TO RELATED APPLICATIONS

This application claims priority to Italian Application No. MI2014A000654, filed on Apr. 8, 2014, the contents of which are hereby incorporated by reference in its entirety.

The present invention relates to a door for a domestic cooking oven, a process of assembling a door for a domestic cooking oven and a domestic cooking oven. The present invention particularly relates to ovens of the pyrolytic type, doors of ovens of the pyrolytic type and processes of assembly thereof.

The known cooking ovens are provided with a door for accessing the cooking chamber.

The door usually has one or more glass plates capable of simultaneously reducing the loss of heat from the oven through the door itself and guaranteeing the user visibility of the cooking chamber and of the food contained therein, without there being any need to open the door.

There are known ovens of the pyrolytic type, which provide for a suitable self-cleaning cycle by means of pyrolysis. Pyrolysis is a process of decomposition of a compound with thermal means and it enables, upon activation of the dedicated cycle, the cooking chamber of the ovens to be cleaned through pulverization of the substances, is carried out by raising the temperature to very high values, even above 500° C. In this manner, the surfaces of the muffle and any baking pans and grills present inside the oven during the pyrolytic cycle can also be sanitized.

In the known ovens of the pyrolytic type, there are usually three glass plates, which are necessary to avoid heat loss towards the outside of the oven; this is particularly undesirable, as it would compromise the efficiency of the pyrolysis cycle, which requires high operating temperatures.

In the known ovens, the glass plates can be removably fitted in the door.

Removable installation of the glass plates in the door derives mainly from the need for a periodic cleaning of the glass plates, and it moreover enables them to be replaced as needed.

The known ovens have dedicated mechanisms enabling the glass plates to be removed.

Such mechanisms are capable of locking the glass plates in the door and releasing the mechanism permits the removal of the glass plates themselves.

Such mechanisms are usually engaged to the door by means of screws and thus to enable removal of the glass plates the mechanisms must be unscrewed. Following cleaning or replacement of the glass plates, the glass plates are set back into their respective seats in the door and the mechanism is screwed back onto the door.

However, the process of assembling the door is particularly long.

Moreover, releasing the dedicated mechanism to enable removal of the glass plates is not particularly easy.

A principal object of the present invention is to resolve one or more of the problems found in the prior art.

One object of the present invention is to provide a door for a domestic cooking oven endowed with a stable and rational mechanism of locking and unlocking the plates in the door.

An additional object of the present invention is to provide an oven whose plates are easily removable from the door.

A further object of the present invention is to simplify the process of assembling the door of domestic cooking ovens.

These objects and still others, which will become more apparent from the following description, are substantially achieved by a door for a domestic cooking oven, a domestic cooking oven comprising said door and a process of assembling a door for a domestic cooking oven, according to what is disclosed in one or more of the appended claims and/or in one or more of the following aspects, taken on their own or in combination, or in combination with any of the further aspects or features described hereunder.

In a first aspect, a door (3) of a domestic cooking oven (1) is envisaged, comprising:

- a first and a second upright beam (8, 9) having a prevalent longitudinal development and reciprocally parallel, each upright beam (8, 9) having a respective first and a respective second end portion (10, 11) reciprocally opposite with reference to the prevalent longitudinal development of the respective upright beam (8, 9);
- at least a first and a second plate (31, 32) having longitudinal edges (38) reciprocally parallel and opposite, and transversal edges (39) also reciprocally parallel and opposite, extending orthogonally to the longitudinal edges (38), the first and second upright beams (8, 9) being fixed to the first plate (31) and the longitudinal edges (38) of the second plate (32) being removably coupled to the upright beams (8, 9) in a mounting position in which the first plate (31) defines an outer surface of the door (3) and the second plate (32) is set parallel and internally relative to the first plate (31);
- a first and a second locking element (14, 15) removably or movably engaged respectively to the first and second upright beams (8, 9) in the respective first end portion (10) of said upright beams (8, 9), the locking elements (14, 15) being configured to be selectively movable between at least one operating position, wherein they are engaged to the respective upright beams (8, 9) in such a way as to lock at least the second plate (32) in the mounting position and at least one unlocked position, wherein they enable the extraction of the second plate (32) from the door (3), wherein the door (3) comprises a first portion (4) and a second portion (5) opposite the first portion (4), the door (3) being rotatably mountable on a frame (2) of an oven (1) in the second portion (5).

In a second aspect in accordance with the first aspect, the first end portion (10) of the upright beams (8, 9) is positioned in the first portion (4) of the door (3) and the second end portion (11) of the upright beams (8, 9) is positioned in the second portion (5) of the door (3).

In a third aspect in accordance with the first aspect, the first end portion (10) of the upright beams (8, 9) is positioned in the second portion (5) of the door (3) and the second end portion (11) of the upright beams (8, 9) is positioned in the first portion (4) of the door (3).

In a fourth aspect in accordance with the first or second or third aspect, the door (3) comprises in the first portion (4) a handle (30) positioned on the outer surface of the first plate (31) and a reinforcement element (13) positioned and fixed internally relative to the first plate (31) relative to the handle (30), said reinforcement element (13) extending transversally along a width of the door (3) and the first and the second locking elements (14, 15) being placed in proximity to opposite ends of the reinforcement element (13).

In a fifth aspect in accordance with the fourth aspect, the reinforcement element (13) and the first and second locking elements (14, 15) are formed by three distinct pieces.

In a sixth aspect in accordance with any of the aspects from the first to the fifth, each locking element (14, 15) has a latch/unlatch mechanism (17) enabling the locking element (14, 15) to selectively switch between the operating position and the unlocked position.

In a seventh aspect in accordance with any of the aspects from the first to the sixth, each locking element (14, 15) has a latch/unlatch mechanism (17), each latch/unlatch mechanism (17) comprising a deformable portion (18) cooperating with the first end portion (10) so as to enable the locking element (14, 15) to switch from the operating position into the unlocked position.

In an eighth aspect in accordance with any of the aspects from the first to the seventh, each locking element (14, 15) has a latch/unlatch mechanism (17) of a snap type.

In a ninth aspect in accordance with the sixth or seventh or eighth aspect, each locking element (14, 15) has an actuating portion (20) shaped as a button suitable for actuating said latch/unlatch mechanism (17).

In a tenth aspect in accordance with any of the aspects from the sixth to the ninth, each locking element (14, 15) has a actuating portion (20) suitable for actuating said latch/unlatch mechanism (17) and each upright beam (8, 9) comprises in the first end portion (10) a coupling portion (19) receiving, in the operating position of the locking element (14, 15), said actuating portion (20), actuating said portion (20) enabling the locking element (14, 15) to switch from the operating position to the unlocked position.

In an eleventh aspect in accordance with any of the aspects from the first to the tenth, each upright beam (8, 9) has, in the second end portion (11), one or more limit-stop supports (123) for the plates (32, 33), at least one transversal edge (39) of the second plate (32) and/or of the third plate (33) being in abutment, respectively, against at least one of said supports (123).

In a twelfth aspect in accordance with any of the aspects from the first to the eleventh, the door (3) comprises one or more hinges (6) intended to be engaged to the frame (2) of an oven (1), said at least one hinge (6) being engaged to the door (3) in the second portion (5).

In a thirteenth aspect in accordance with any of the aspects from the first to the twelfth, each locking element (14, 15) has a latch/unlatch mechanism (17) enabling the locking element (14, 15) to selectively switch between the operating position and the unlocked position, the latch/unlatch mechanism (17) comprising a deformable portion (18) cooperating with the first end portion (10) to enable the locking element (14, 15) to switch from the operating position to the unlocked position, the deformable portion (18) consisting of an elastically deformable tab comprising a protuberance engageable in the operating position of the locking elements (14, 15) to a coupling portion (19) in the first end portion (10) of the respective upright beams (8, 9), preferably in a through opening (191) fashioned in the first end portion (10) of the respective upright beams (8, 9).

In a fourteenth aspect, a domestic cooking oven (1) is envisaged, comprising:

- an external frame (2);
- a muffle housed inside the frame (2) and defining a cooking chamber;
- a door (3) for accessing the cooking chamber in accordance with any of the aspects from the first to the thirteenth.

In a fifteenth aspect in accordance with the fourteenth aspect, an oven (1) is envisaged which further comprises a door locking mechanism (22) configured to selectively operate between a position of constraining the door (3), in which it prevents the door (3) from opening, at least in a condition of high temperature of the oven (1) during a process of pyrolytic cleaning thereof, and a release position, in which it does not prevent the door (3) from opening, said mechanism (22), in the position of constraining the door (3), being engaged to said first upright beam (8) and extending at least partially within said first locking element (14).

In a sixteenth aspect in accordance with the fifteenth aspect, the first locking element (14) has at least one opening (21) disposed in a upper and/or lower portion of the locking element (14), the door locking mechanism (22) comprising a constraining element (220) that extends at least partially within the first locking element (14) at said at least one opening (21).

In a seventeenth aspect, a process of assembling a door (3) of a domestic cooking oven (1) is envisaged, the door (3) being in accordance with any of the aspects from the first to the thirteenth and the oven (1) being in accordance with the fourteenth or fifteenth or sixteenth aspect, said process comprising the steps of:

- providing a first and a second upright beam (8, 9) having a prevalent longitudinal development and being reciprocally parallel, each upright beam (8, 9) being provided with at least one guiding portion (12) for receiving one or more plates and one or more limit-stop supports (123) for one or more plates;
- providing at least a first and a second plate (31, 32) having longitudinal edges (38) reciprocally parallel and opposite and transversal edges (39), also reciprocally parallel and opposite, extending orthogonally to the longitudinal edges (38);
- providing a first and a second locking element (14, 15);
- fixing said first and said second upright beam (8, 9) to the first plate (31), said first plate (31) defining an outer surface of the door (3);
- inserting said second plate (32) in guiding portions (12) of the first and second upright beams (8, 9) until a transversal edge (39) comes to abut against one or more limit-stop supports (123) of the upright beams (8, 9);

following the insertion at least of the second plate (32), removably or movably engaging the first and second locking elements (14, 15) in respective end portions (10, 11) of the upright beams (8, 9) and positioning them in an operating position so as to lock at least the second plate (32) in the mounting position and prevent the extraction thereof from the door (3).

In an eighteenth aspect in accordance with any of the preceding aspects, the first and second upright beams (8, 9) are glued to the first plate (31).

There now follows, by way of non-limiting example, a detailed description of one or more preferred embodiments of the invention, in which.

Figure 1:
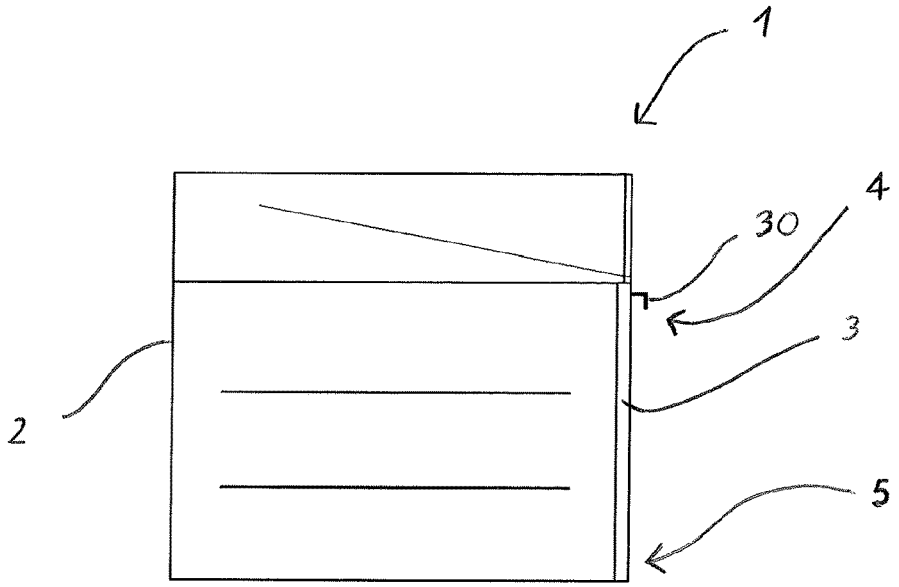
FIG. 1 represents a domestic cooking oven according to the present invention.

With reference to the figure, 1 denotes overall a domestic cooking oven, for example of the pyrolytic type.

The oven 1 comprises a frame 2, which constitutes an external weight-bearing structure of the oven 1 and houses within it a muffle defining a cooking chamber.

The oven 1 further comprises a door 3 rotatably engaged to the frame 2 and movable between a closed position, in which it precludes access to the cooking chamber, and an open position, in which the cooking chamber is accessible from outside the oven 1.

The door 3 comprises a first and a second portion 4, 5 which are reciprocally opposite; in the second portion 5, the door 3 can be rotatably engaged to the frame 2, for example by means of one or more hinges 6.

Preferably, the second portion 5 of the door 3 is hinged in a lower front portion of the oven 1, so as to enable the door 3 to be opened and closed by rotating it about a substantially horizontal axis.

The door 3 further comprises a handle 30 positioned in the first portion 4 of the door 3, as illustrated in FIG. 1; the handle 30 enables the door 3 to be easily gripped and moved between the closed position and the open position.

The door 3 comprises at least a first and a second plate 31, 32. Advantageously, for example in ovens of the pyrolytic type, the door 3 can further comprise a third plate 33. Optionally, in ovens of the pyrolytic type a fourth plate (not illustrated in the appended figures) can also be provided.

Preferably, the plates 31, 32, 33 are made of a suitable material enabling visual accessibility to the cooking chamber and the food contained therein without there being any need to open the door 3.

Figure 5:
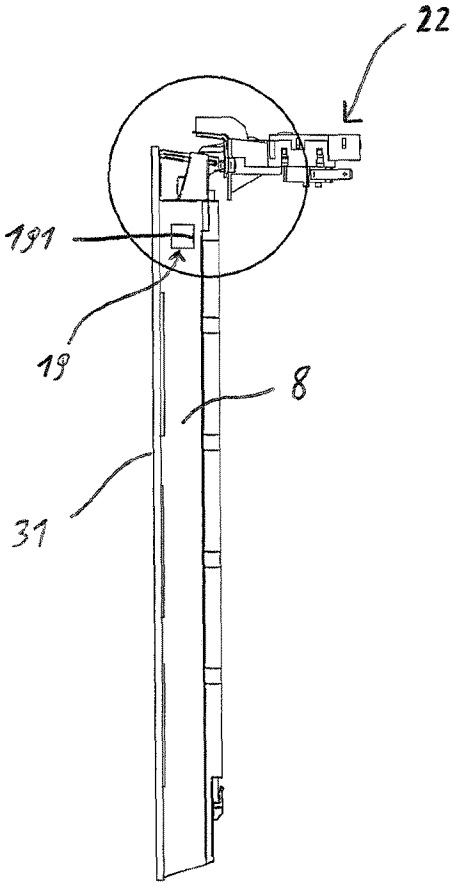
FIG. 5 represents a side view of the door of FIG. 3, with some elements removed.
Figure 8:
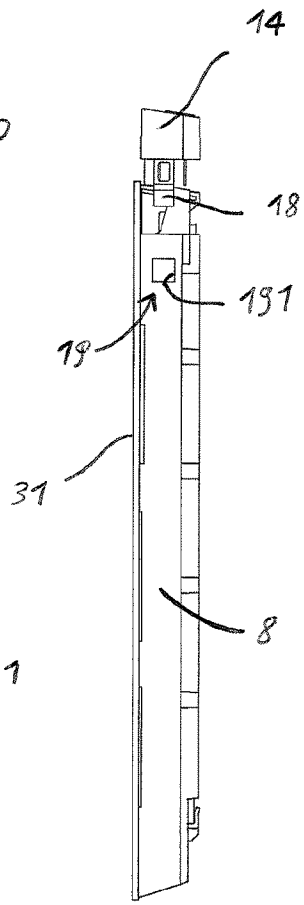
FIG. 8 represents a side view of the door of FIG. 7.

The first plate 31 defines an outer surface of the door 3, as illustrated, for example, in FIG. 5 and in FIG. 8.

The plates 31, 32, 33 have longitudinal edges 38 which are reciprocally parallel and opposite and transversal edges 39, also reciprocally parallel and opposite, extending orthogonally to the longitudinal edges 38.

From a dimensional viewpoint, the plates can have overall dimensions that differ from one another; for example the first plate 31 can have a greater length (calculated as the distance between the opposite longitudinal edges 38) and height (calculated as the distance between the opposite transversal edges 39) than the second and/or the third plate 32, 33. As illustrated by way of non-limiting example in FIG. 11, the first plate 31 has a length and a height that are greater than the length and height of the other plates 32, 33 and the second plate 32 can have a length that is shorter than the length of both the first and third plates 31, 33. Given the shorter length of the second plate 32 relative to the respective lengths of the first and third plates 33, the sectioning plane of the section XIV-XIV illustrated in FIG. 12 does not intercept the second plate 32 (broken line in FIG. 12) and therefore in the corresponding section XIV-XIV of FIG. 13 the first and third plates 31, 33 are illustrated.

The door 3 further comprises a first and a second upright beam 8, 9, which are configured to engage one or more plates, as will be described below. In other words, the first and second upright beams 8, 9 form a frame configured to receive one or more plates. The first and second upright beams 8,9 have a prevalent longitudinal development and have a first and a second end portion 10, 11 reciprocally opposite along the longitudinal extent of the upright beams 8,9.

The first and second upright beams 8,9 are fixed to the first plate 31, for example by gluing. Advantageously, the first and second upright beams 8,9 are formed by two distinct pieces, which can be fixed to the first plate 31 independently of each other. The first and second upright beams 8, 9 are engaged to the first plate 31 in such a way that the first and second end portions 10, 11 are respectively positioned in the first and second portions 4, 5 of the door 3.

With regard to the second and third plates 32, 33, they are removably engaged to the upright beams 8,9 at least at the respective longitudinal edges 38.

Figure 16:
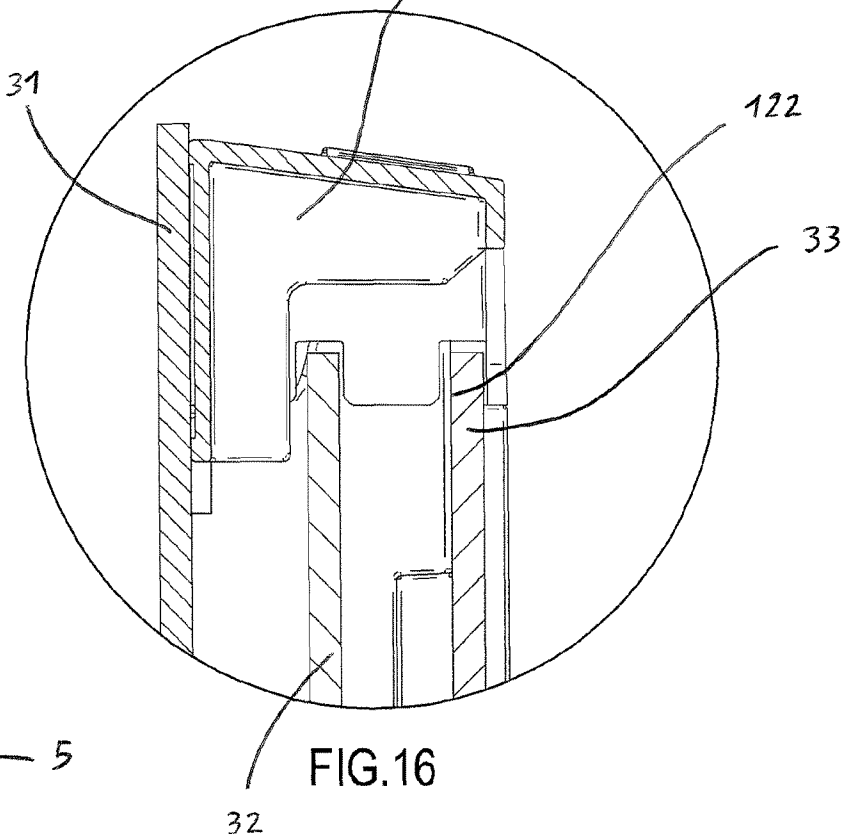
FIG. 16 represents a detail of FIG. 15.

In the mounting position of the plates, the first plate 31 is fixed to the upright beams 8,9 and the second and third plates 32, 33 are removably engaged to the upright beams 8,9. In particular, the first, second and third plates 31, 32, 33 are arranged parallel to one another and are respectively positioned in an outer portion, in an intermediate position in an inner portion of the door 3. In other words, the first plate 31 defines the outer surface of the door 3, the second plate 32 is an intermediate plate and the third plate 33 defines the inner surface of the door 3 facing toward the cooking chamber in the closed position of the door 3, as illustrated in FIG. 15 and in FIG. 16.

Figure 11:
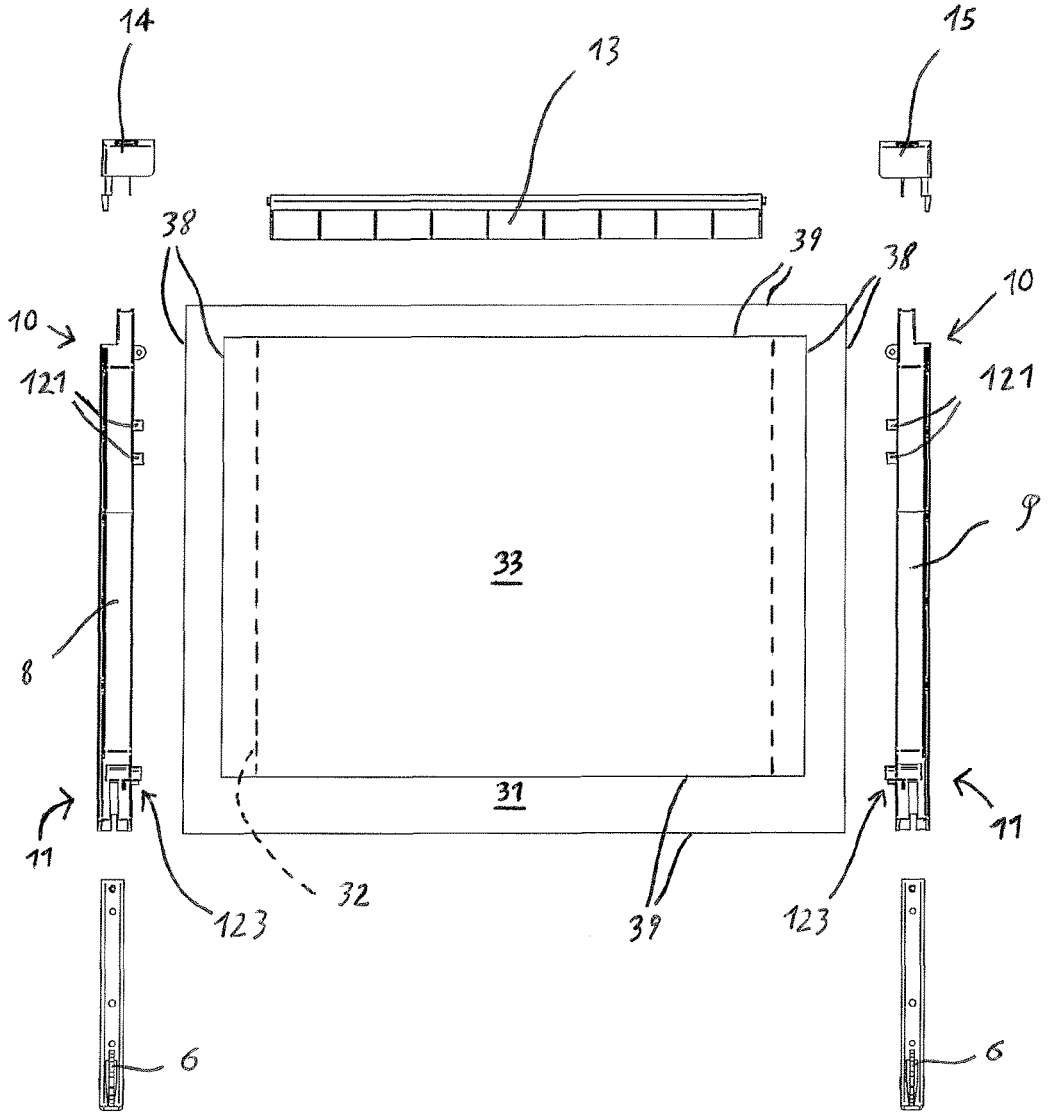
FIG. 11 represents another exploded view of the door according to the present invention.
Figure 15:
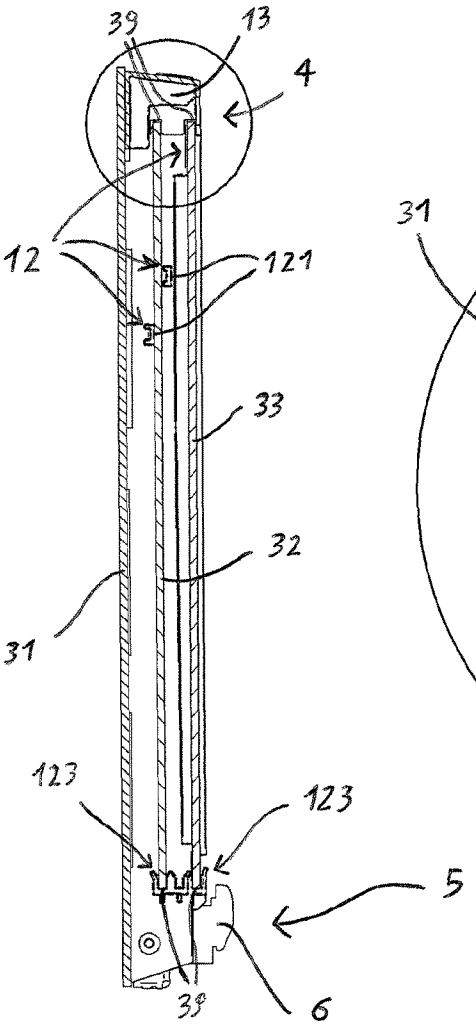
FIG. 15 represents the section XVI-XVI of FIG. 12.

In order to enable the second and third plates 32, 33 to be inserted and housed in the upright beams 8,9, the latter are provided with respective guiding portions 12, as illustrated in FIG. 15. In particular, each upright beam 8, 9 is provided with at least one first guiding portion 121 designed and intended to enable the second plate 32 to be slidingly received in the mounting position. FIG. 11, for example, illustrates an embodiment wherein each upright beam 8,9 is provided with two first guiding portions 121.

If a third plate 33 is also provided, the first and second upright beams 8, 9 can further comprise a second guiding portion 122 designed and intended to enable the third plate 33 to be received and to at least partially come into abutment against the third plate 33 in the mounting position of the third plate 33.

Figure 14:
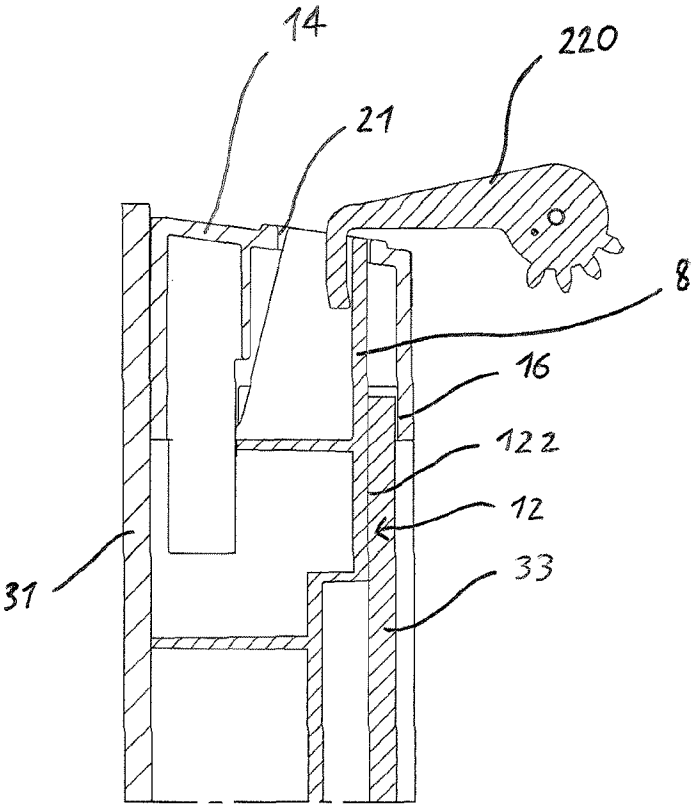
FIG. 14 represents the section XV-XV of FIG. 12.
Figure 13:
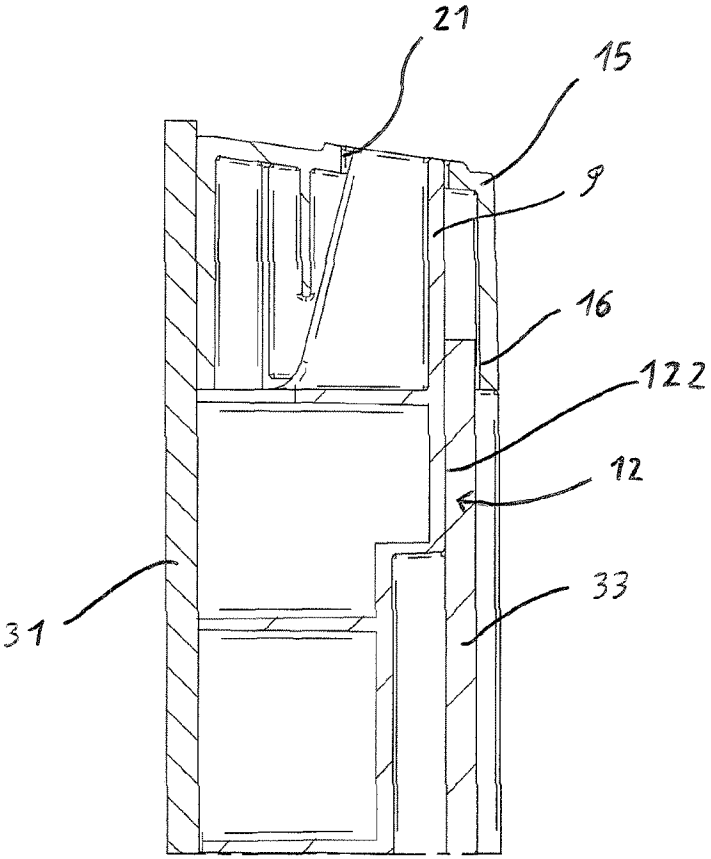
FIG. 13 represents the section XIV-XIV of FIG. 12.

The mounting position of the third plate 33 is for example illustrated in FIGS. 13 and 14.

Figure 9:
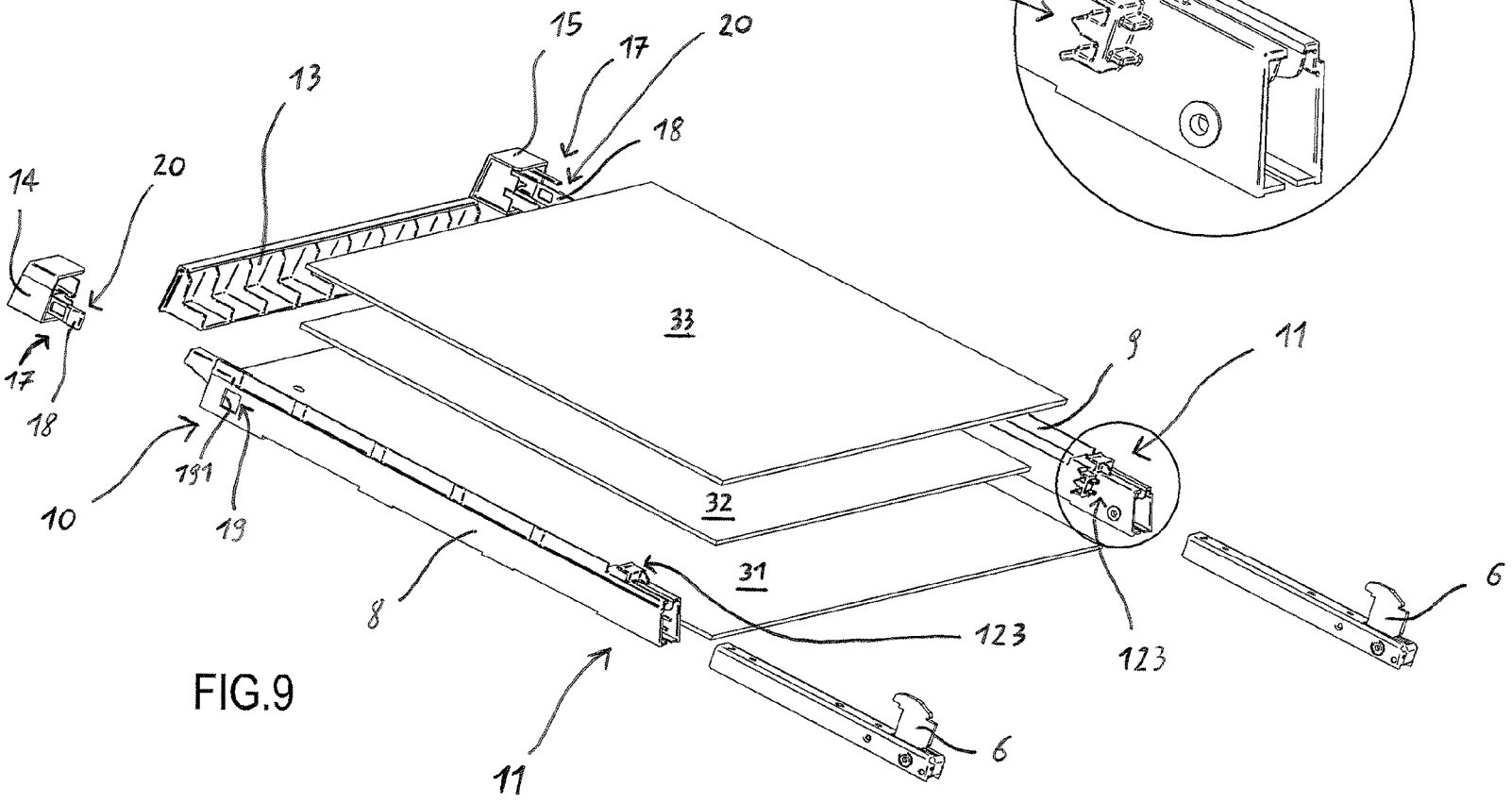
FIG. 9 represents an exploded view of the door according to the present invention.

The first and second upright beams 8, 9 can further comprise, respectively, one or more limit-stop supports 123 for the second and third plates 32, 33 set in the respective second end portions 11, as illustrated in FIG. 9.

The limit-stop supports 123 are suitable for ensuring at least one abutment surface against which the transversal edges 39 of the second and third plates 32, 33 come into abutment upon the insertion of the second and third glass plates 32, 33 in the door 3. The upright beams 8, 9 can have a single limit-stop support 123 comprising a plurality of grooves whose number is equal to that of the plates to be removably received in the door 3 or a plurality of limit-stop supports 123.

Figure 10:
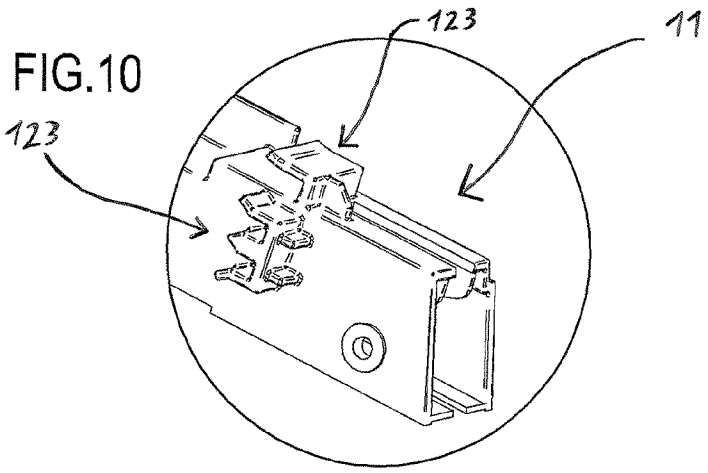
FIG. 10 represents a detail of the door of FIG. 9.

As illustrated by way of non-limiting example in FIG. 10, the upright beams 8, 9 can have, for example, two limit-stop supports 123; in the mounting position of the plates 32, 33, the lower transversal edge 39 of the second plate 32 is in abutment against one of the two limit-stop supports 123 and the lower transversal edge 39 of the third plate 33 is in abutment against the limit-stop support 123.

The mounting position of the plates 31, 32, 33 is for example illustrated in FIG. 15.

In the first portion 4, the door 3 can further comprise a reinforcement element 13 (also called head piece), which is configured to impart structural solidity to the door 3 and extends transversely to the upright beams 8, 9 along a width of the door 3. Advantageously, the reinforcement element 13 is positioned and fixed, for example by gluing, internally to the first plate 31 in an opposite position relative to handle 30, which is positioned on the outer surface of the first plate 31.

The door 3 further comprises a first and a second locking element 14, 15, mutually distinct and separate, of the second and of the third plate 32, 33. The locking elements 14, 15 are engaged, respectively, to first and second upright beams 8,9 in the respective first end portions 10 and are configured to be selectively movable between at least one operating position and at least one unlocked position.

Figure 2:
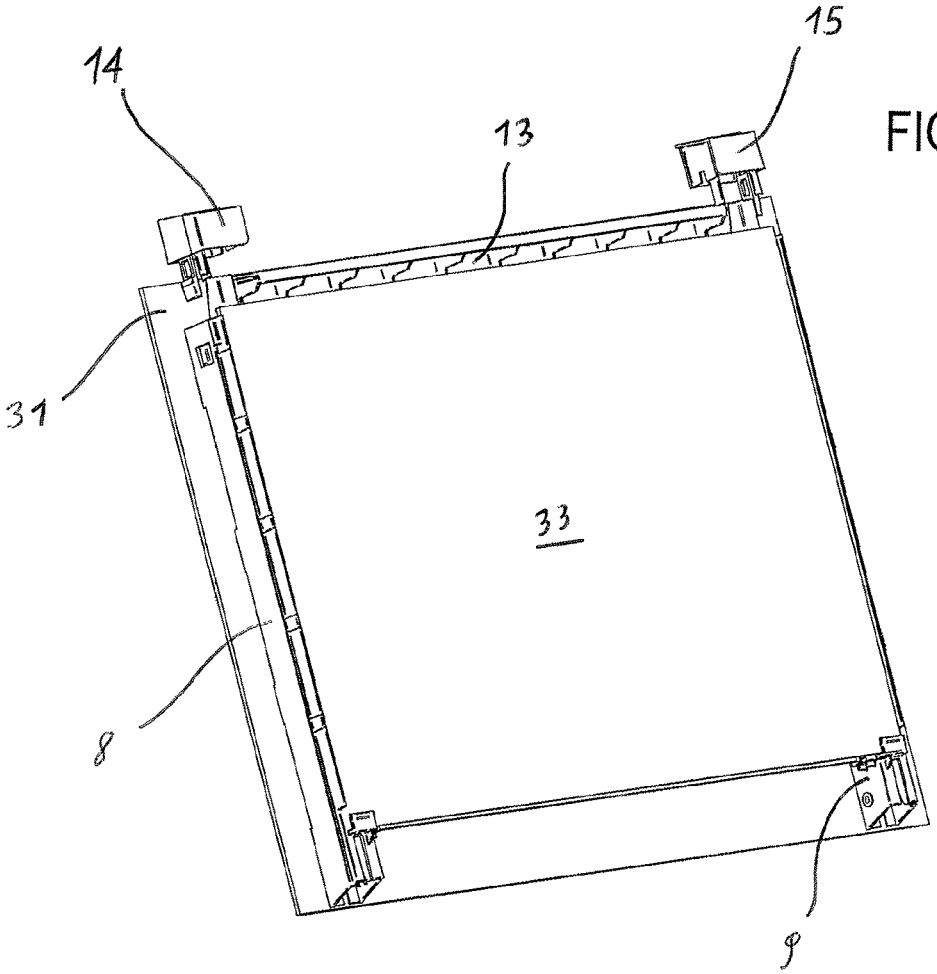
FIG. 2 represents an axonometric view of the door of an oven according to the present invention.
Figure 3:
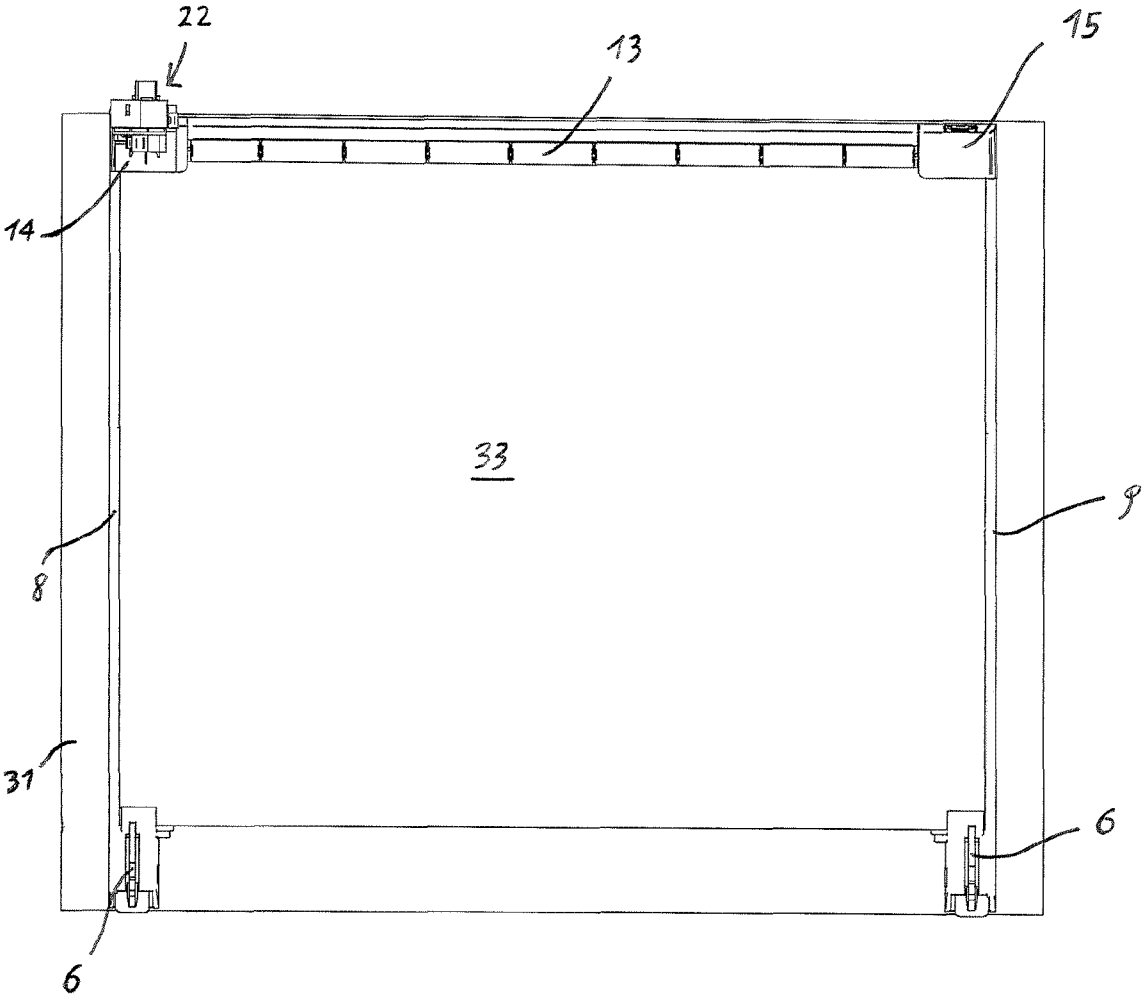
FIG. 3 represents a rear view of the door of the oven of FIG. 1 to which a door locking mechanism is engaged.
Figure 7:
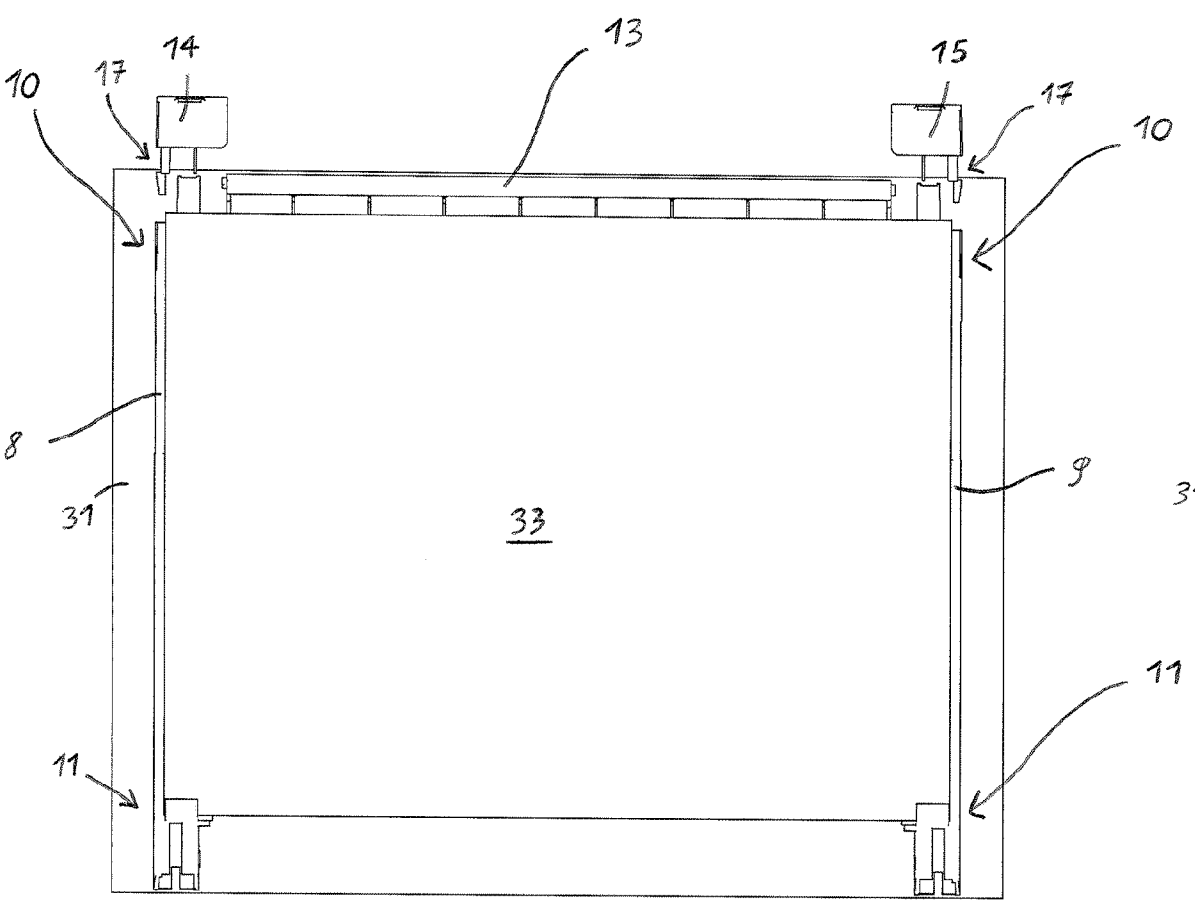
FIG. 7 represents a rear view of the door of an oven according to the present invention.

In the operating position the locking elements 14, 15 are engaged to the respective upright beams 8,9 in such a way as to lock the second and third plates 32, 33 in the mounting position, whilst in the unlocked position the locking elements 14, 15 enable the second and third plates 32, 33 to be extracted from the door 3. The operating position of the locking elements 14, 15 is for example illustrated in FIGS. 3, 4 and 12, whilst FIGS. 2, 7, 8 illustrate the locking elements 14, 15 disengaged from the upright beams 8, 9, in a possible unlocked position.

Advantageously, the first and second locking elements 14, 15 are distinct from each other, so that they can be independently engaged to and disengaged from the respective upright beams 8, 9. In other words, the first locking element 14 is formed by one piece and the second locking element 15 is formed by another piece that is distinct and separate from the piece forming the first locking element 14.

In the first portion 4 of the door 3, the first and second locking elements 14, 15 can be placed in proximity to opposite ends of the reinforcement element 13. In particular, the reinforcement element 13 and the first and second locking elements 14, 15 form three distinct pieces.

When the locking elements 14, 15 are in the unlocked position, the user, in order to extract the second or third plate 32, 33, lifts the plate vertically for a first length and then rotates it in such a way as to pull it out diagonally relative to the first plate 31, which is non-removably fixed to the upright beams 8, 9. In the non-limiting example embodiment illustrated in the figures, the rotation of the second and third plates 31, 33 is necessary in order to be able to extract them since positioned above the plates 31, 33 there is the reinforcement element 13, which has overall dimensions such as to prevent, depending on its depth in the direction orthogonal to the first plate 31 to which it is engaged, the extraction of the second and of the third plate 32, 33 in a direction parallel to the first plate 31.

The first and second locking elements 14, 15 can further have an abutment surface 16, which, in the operating position of the locking elements 14, 15, is facing an end portion of a prevalent development surface (the front or rear flat surface) of the second and/or third plate 32, 33, or is in abutment against said prevalent development surface. FIGS. 13 and 14 illustrate the abutment surfaces 16 of the first and second locking elements 14, 15.

The locking elements 14, 15 can be movably or removably engaged to the respective upright beams 8,9.

If they are movably engaged, the locking elements 14, 15 will be constrained to the respective upright beams 8, 9 both in the operating position and in the unlocked position. According to this engagement, in order to switch between the operating position and the unlocked position there can be envisaged a movement of rotation and/or translation of the locking elements 14, 15 relative to the respective upright beams 8, 9, away from the operating position, notwithstanding the connection between the locking elements 14, 15 and the respective upright beams 8, 9. Following this movement of the locking elements 14, 15, the plates can be extracted from the door 3.

If they are removably engaged, in the operating position the locking elements 14, 15 will be constrained to the respective upright beams 8, 9, whilst in the unlocked position they will be disengaged and removed from the upright beams 8, 9 in order to enable extraction of the plates.

According to a preferred embodiment of the present invention, the engagement between the locking elements 14, 15 and the respective upright beams 8, 9 is of a removable type.

The first and second locking elements 14, 15 have a latch/unlatch mechanism 17 which, as a consequence of the actuation of the mechanism 17 itself, enable them to switch selectively between the operating position and the unlocked position. The latch/unlatch mechanism 17 of the first and second upright beams 8, 9 can comprise a deformable, in particular elastically deformable portion 18, intended to be engaged in at least one coupling portion 19 of the first and second upright beams 8, 9.

Figure 4:
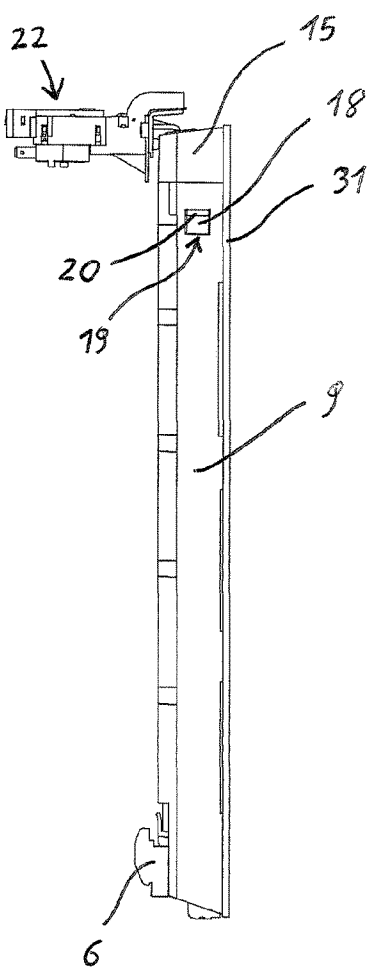
FIG. 4 represents a side view of the door of FIG. 3.

Preferably, the coupling portion 19 is disposed in the first end portion 10 of each upright beam 8, 9. In the operating position of the locking elements 14, 15, the deformable portions 18 of the latch/unlatch mechanisms 17 of the first and second locking elements 14, 15 are engaged to the first and second upright beams 8, 9 in respective coupling portions 19, as illustrated in FIG. 4 with reference to the second locking element 15 and second upright beam 9.

Each coupling portion 19 can consist, for example, of a through opening 191, as illustrated in FIG. 8 and in FIG. 9 with reference to the first upright beam 8.

Preferably, the latch/unlatch mechanism 17 is a mechanism of the snap type.

The latch/unlatch mechanism 17 can further comprise an actuating portion 20 shaped as a button which enables the latch/unlatch mechanism 17 to be acted on in such a way as to switch the respective locking element 14, 15 from the operating position to the unlocked position. Advantageously, the actuating portion 20 of the latch/unlatch mechanism 17 can coincide with the deformable portion 18. In the operating position of the locking elements 14, 15, the button-shaped actuating portion 20 is housed in the coupling portion 19, formed, for example, by the through opening 191. Advantageously, the actuation of the button-shaped actuating portion 20 is facilitated by the presence of the through opening 191.

However, switching the locking elements 14, 15 from the unlocked position to the operating position can be achieved simply by engaging the first and second locking elements 11, 15, respectively, to the first and second upright beams 8, 9 in the respective coupling portions 19. In other words, at the time the locking elements 14, 15 engage the first and second upright beams 8, 9, the deformable portion 18, on reaching the corresponding coupling portion 19, will engage thereto by means of a snap movement. Therefore, in the operating position of the locking elements 14, 15, they are substantially wedged into the respective coupling portions 19 placed in the first end portions 10, respectively, of the first and second upright beams 8, 9.

In order to subsequently unlock the locking/release mechanism 17, it is necessary to act on the button-shaped actuating portion 20, which, on deforming elastically, disengages from the respective coupling portion 19, enabling the removal of the locking elements 14, 15.

Advantageously, the locking elements 14, 15 can be manually engaged to the respective upright beams 8, 9 without the use of tools.

According to a preferred embodiment of the present invention, at least the first locking element 14 is hollow at the top and/or bottom; in other words, it can have an opening 21 located in an upper and/or lower portion of the locking element 14. Advantageously, both the first and second locking elements 14, 15 have a respective opening 21.

For example, FIGS. 13 and 14 illustrate a first locking element that has an upper opening 21.

As said previously, domestic cooking ovens 1 of the pyrolytic type envisage suitable high-temperature pyrolytic cleaning cycles. During this operating mode, it is important to prevent the door 3 from being opened and therefore access to the cooking chamber; further operating modes of the oven 1 can also be envisaged, during which it can be advantageous to prevent the door 3 from being opened. For example, the opening of the door 3 can be prevented in the presence of children in the room where the oven 1 is located in order to ensure their safety.

To this end, the domestic ovens 1 of the pyrolytic type according to the present invention can comprise a door locking mechanism 22 configured to operate selectively between a position of constraining the door 3, in which it prevents the door 3 from being opened, and a position of releasing the door 3, in which it does not prevent the door 3 from being opened.

Figure 12:
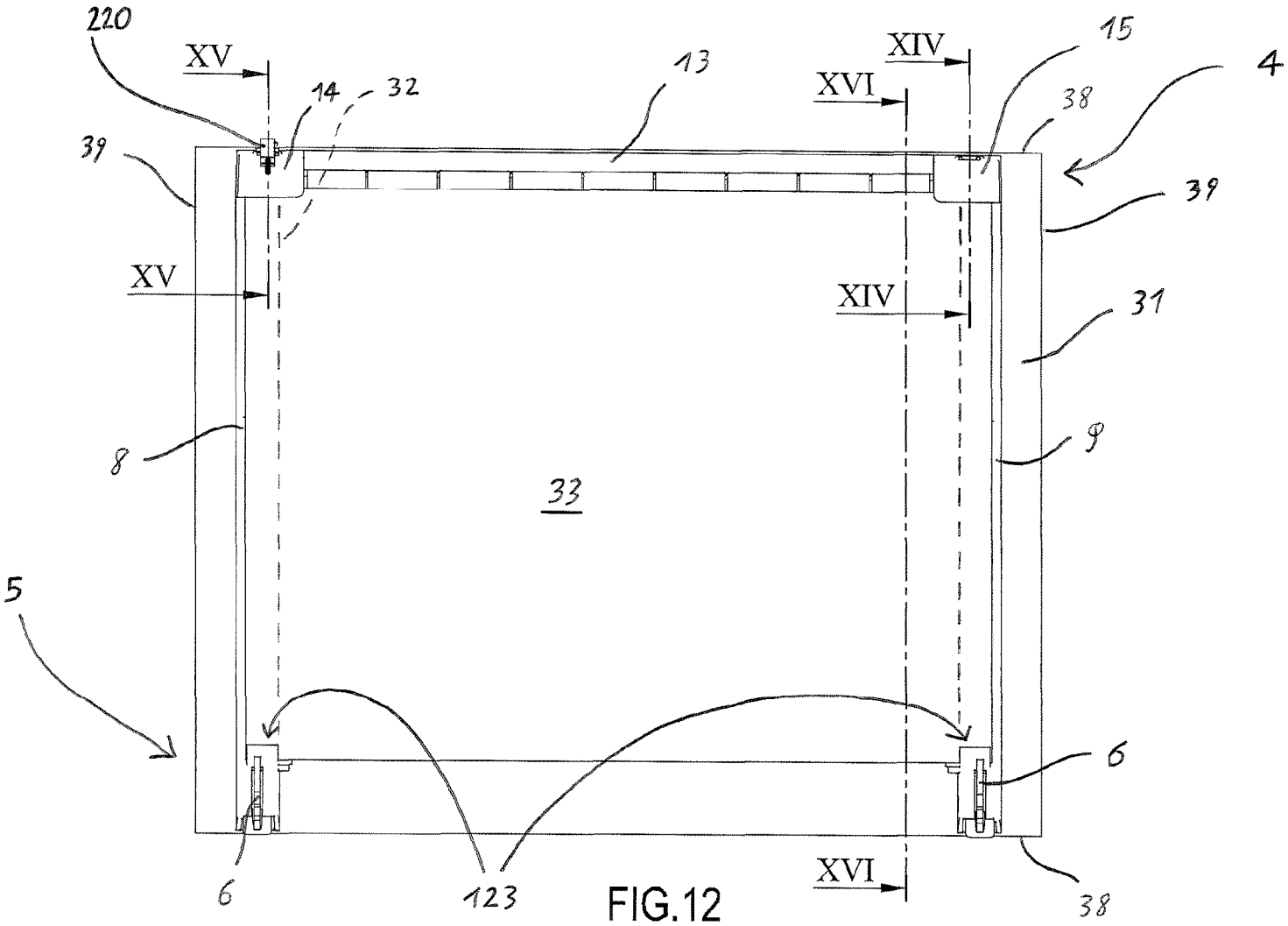
FIG. 12 represents a rear view of the door according to the present invention to which a door locking mechanism is engaged, with some elements removed.

The door locking mechanism 22 comprises a constraining element 220, which, in the position of constraining the door 3, is engaged to the first upright beam 8 in the first end portion 10, as illustrated in FIG. 12 and in FIG. 14. In FIG. 14 it is further possible to note that, in the position of engagement of the constraining element 220 to the first upright beam 8, the constraining element 220 extends at least partially within the first locking element 14 at the upper opening 21. The constraining element 220 extends partially within the first locking element 14 until coming into contact with the first upright beam 8.

According to a variant non illustrated in the appended figures, the constraining element 220 can extend at least partially within the first locking element 14 at a lower opening 21.

Figure 6:
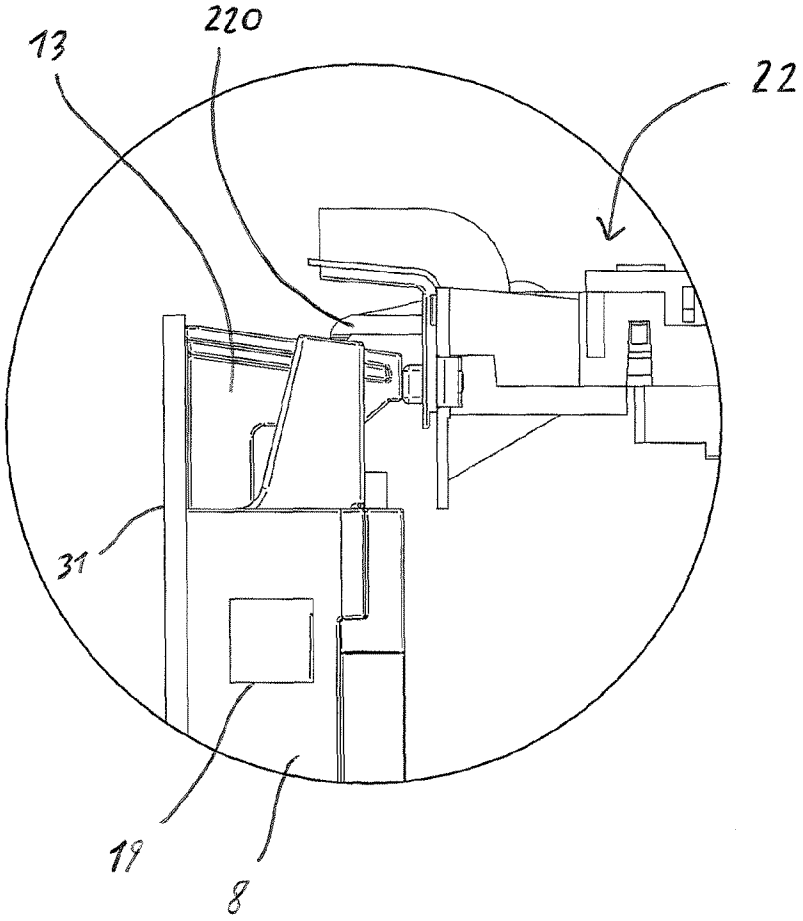
FIG. 6 represents a detail of the door of FIG. 5.

FIG. 5 and FIG. 6, on the other hand, illustrate the entire door locking mechanism 22; the locking elements 14, 15 are not represented in such figures in order to illustrate the engagement of the constraining element 220 to the first upright beam 8.

The constraining element 220 can for example consist of a latch.

Locking of the door 3 is ensured by actuation of the locking mechanism 22, which results in the switching from the release position of the door 3 to the position of constraining the door 3. Actuation of the door locking mechanism 22 moves the constraining element 220 from the release position of the door 3 to the position of constraining the door 3, for example by means of one or more translational or rotational-translational movements of the constraining element 220.

The door locking mechanism 22 can be manually actuated by the user, for example by pressing a suitable dedicated pushbutton, or it can be automatically actuated by the oven 1 following the selection of one or more operating modes of the oven 1 (such as pyrolytic cleaning) or as a consequence of a given threshold value of an operating parameter of the oven 1 being exceeded. For example, an oven 1 of the pyrolytic type can automatically actuate the door locking mechanism 22 as a consequence of a threshold temperature (for example during the pyrolysis cycle) being exceeded by the temperature inside the cooking chamber.

The present invention further relates to a process of assembling a door for a domestic cooking oven 1, particularly an oven of the pyrolytic type.

The process comprises fixing the first and second upright beams 8, 9 to the first plate 31; subsequently, the second and third plates 32, 33 are inserted in the guiding portions 22 of the first and second upright beams 8, 9 until the transversal edges 39 of the plates 32, 33 come into abutment against the respective limit-stop supports 123. After the plates 32, 33 have been engaged to the upright beams 8,9, the first and second locking elements 14, 15 are engaged, respectively, to the first and second upright beams 8, 9 in the first respective end portions 10.

The present invention makes it possible to obtain one or more of the following advantages and to resolve one or more of the problems encountered in the prior art.

First of all, the present invention makes it possible to lock the plates in the door and to remove the locking elements of the plates without the aid of tools.

The present invention further provides a simple and rational process of assembling the door of an oven.

The invention is moreover convenient to use, easy to implement and simple and economical to construct.

The invention claimed is:

1. A door for a domestic cooking oven comprising:

a first upright beam and a second upright beam having a longitudinal prevalent development and reciprocally parallel, each upright beam having a respective first end portion and a respective second end portion reciprocally opposite with reference to the longitudinal prevalent development of the first upright beam and the second upright beam, at least a first plate and a second plate having longitudinal edges reciprocally parallel and opposite, and transversal edges reciprocally parallel and opposite, extending orthogonally to the longitudinal edges, the first upright beam and the second upright beam being fixed to the first plate and the longitudinal edges of the second plate being removably coupled to the first upright beam and the second upright beam in a mounting position through insertion of the second plate in a guiding portion of each of the first upright beam and the second upright beam, wherein the first plate defines an outer surface of the door and the second plate is arranged parallel to the first plate, a reinforcement device fixed to the first plate, wherein the reinforcement device extends transversally along a width of the door, a first distinct locking device and a second distinct locking device configured to respectively engage and disengage with the first upright beam and the second upright beam, wherein the first distinct locking device and second distinct locking device flank opposite ends of the reinforcement device and the reinforcement device, the first distinct locking device, and the second distinct locking device are separate and distinct from each other, wherein the first distinct locking device and the second distinct locking device are respectively engaged with the first upright beam and the second upright beam when an actuating portion, of each of the first distinct locking device and the second distinct locking device, is housed in a respective opening on an exterior portion of the longitudinal prevalent development of the first upright beam and the second upright beam to lock at least the second plate in the mounting position, wherein the first distinct locking device and the second distinct locking device are respectively disengaged with the first upright beam and the second upright beam when the actuating portion, of each of the first distinct locking device and the second distinct locking device, is not housed in the respective opening on the exterior portion of the longitudinal prevalent development of the first upright beam and the second upright beam to extract at least the second plate in an unlocked position, wherein the door includes a first portion and a second portion opposite to the first portion, the door being rotatably mountable to a frame of the oven at the second portion, the first end portion of the first upright beam and the second upright beam being positioned at the first portion of the door and the second end portion of the first upright beam and the second upright beam being positioned at the second portion of the door.

2. The door according to claim 1, wherein the door further comprises a third plate, wherein the second plate is interposed between the first plate and the third plate, the third plate being mounted parallel to the second plate and defining an inner surface of the door, wherein the first distinct locking device and the second distinct locking device are further configured to lock, in the mounting position, and wherein the third plate is in the mounting position and enabling, in the unlocked position, the extraction of the third plate from the door.

3. The door according to claim 2, wherein the first upright beam and the second upright beam are formed by two distinct pieces, each of the two distinct pieces independently fixed to the first plate, wherein the guiding portion of each upright beam is configured to slidingly receive the second plate in the mounting position, and wherein a different guiding portion of each upright beam is configured to slidingly receive the third plate in the mounting position.

4. The door according to claim 1, wherein the first distinct locking device and the second distinct locking device have at least one abutment surface which, in the mounting position of said first distinct locking device and the second distinct locking device faces, or is positioned in abutment to, an end portion of a prevalent development surface of at least one of the second plate and a third plate.

5. The door according to claim 1, wherein each distinct locking device has a latch/unlatch mechanism configured to enable the locking device to selectively switch between the mounting position and the unlocked position and wherein the latch/unlatch mechanism comprises a deformable portion cooperating with the first end portion of the first upright beam and the second upright beam in order to enable the locking device to shift from the mounting position to the unlocked position and wherein the latch/unlatch mechanism is of a snap type.

6. The door according to claim 5, wherein the actuating portion is shaped as a button suitable for actuating said latch/unlatch mechanism, the actuating portion enabling the first distinct locking device and the second distinct locking device to switch from the mounting position to the unlocked position.

7. The door according to claim 1, wherein the door comprises at the first portion a handle arranged on the outer surface of the first plate.

8. A domestic cooking oven comprising:

an external frame;

a muffle housed inside the frame and defining a cooking chamber;

a door for accessing the cooking chamber wherein the door includes a first upright beam and a second upright beam having a longitudinal prevalent development and reciprocally parallel, each upright beam having a respective first end portion and a respective second end portion reciprocally opposite with reference to the longitudinal prevalent development of the first upright beam and the second upright beam, wherein the first upright beam and the second upright beams are fixed to a first plate and longitudinal edges of a second plate are removably coupled to the first upright beam and the second upright beam in a mounting position through insertion of the second plate within a guiding portion of the first upright beam and the second upright beam, wherein the first plate defines an outer surface of the door and the second plate is arranged parallel to the first plate;

a reinforcement device fixed to the first plate, wherein the reinforcement device extends transversally along a width of the door;

a first distinct locking device and a second distinct locking device that are separate devices and distinct from each other and also separate and distinct from the reinforcement device, the first distinct locking device and the second distinct locking device flanking opposite ends of reinforcement device and configured to respectively engage and disengage with the first upright beam and the second upright beam, wherein when the first distinct locking device and the second distinct locking device are respectively engaged with the first upright beam and the second upright beam, an actuating portion, of each of the first distinct locking device and the second distinct locking device, is housed in a respective opening on an exterior portion of the longitudinal prevalent development of the first upright beam and the second upright beam to lock the second plate in the door.

9. The domestic cooking oven according to claim 8, wherein the oven further comprises a door locking mechanism configured to selectively operate between a door constraining position in which it prevents the door from opening, and a release position in which it does not prevent the door from opening, said door locking mechanism, when in the door constraining position, being engaged to said first upright beam and extending at least partially within a first locking device.

10. A method of assembling a door of a domestic cooking oven, the method comprising:

providing a first upright beam and a second upright beam having a prevalent longitudinal development and being reciprocally parallel, each upright beam being provided with at least one guiding portion traveling a length of the first and second upright beam for receiving one or more plates, and the first and second upright beams each having one or more limit-stop supports that abut a transversal edge of the one or more plates, providing at least a first plate and a second plate having longitudinal edges reciprocally parallel and opposite and transversal edges, also reciprocally parallel and opposite, extending orthogonally to the longitudinal edges, providing a reinforcement device fixed to the first plate, wherein the reinforcement devices extends transversally along a width of the door, providing a first locking device and a second locking device, wherein the first locking device is separate from and distinct from the second locking device and wherein the first locking device and second locking device are separate and distinct from the reinforcement device, fixing said first upright beam and said second upright beam to the first plate, said first plate defining an outer surface of the door, inserting said second plate into the guiding portions of the first upright beam and the second upright beam until the transversal edge stops in abutment to the one or more limit-stop supports of the first upright beam and the second upright beam, wherein after the insertion of the second plate, removably or movably engaging the first locking device and the second locking device at respective end portions of the first upright beam and the second upright beam and positioning the first locking device and the second locking device in an operating position for locking the second plate in a mounting position and preventing the second plate from being extracted from the door;

respectively disengaging the first locking device and the second locking device from the first upright beam and the second upright beam to remove the second plate from the guiding portions of the first upright beam and the second upright beam; and lifting and rotating the second plate to avoid the reinforcement device during removal of the second plate from the guiding portions of the first upright beam and the second upright beam.

* * * * *